US006705290B2

(12) United States Patent
Puckett

(10) Patent No.: US 6,705,290 B2
(45) Date of Patent: Mar. 16, 2004

(54) FUEL INJECTION CONTROL SYSTEM AND METHOD

(75) Inventor: Daniel Reese Puckett, Dunlap, IL (US)

(73) Assignee: Caterpillar Inc, Peoria, IL (US)

( * ) Notice: Subject to any disclaimer, the term of this patent is extended or adjusted under 35 U.S.C. 154(b) by 65 days.

(21) Appl. No.: 10/184,890

(22) Filed: Jul. 1, 2002

(65) Prior Publication Data

US 2004/0000288 A1 Jan. 1, 2004

(51) Int. Cl.[7] ..... F02M 7/00
(52) U.S. Cl. ..... 123/446; 123/381
(58) Field of Search ..... 123/446, 381, 123/456, 447, 458, 502

(56) References Cited

U.S. PATENT DOCUMENTS 4,252,097 A * 2/1981 Hartford et al. ..... 123/381
4,955,345 A * 9/1990 Brown et al. ..... 123/381
5,181,494 A * 1/1993 Ausman et al. ..... 123/446
5,357,912 A * 10/1994 Barnes et al. ..... 123/357
5,423,302 A 6/1995 Glassey
5,896,841 A 4/1999 Nemoto et al.
6,026,780 A 2/2000 Barnes et al.
6,102,004 A 8/2000 Cowden et al.
6,360,717 B1 * 3/2002 Chang et al. ..... 123/381

* cited by examiner

*Primary Examiner*—Mahmoud Gimie
(74) *Attorney, Agent, or Firm*—Finnegan, Henderson, Farabow, Garrett & Dunner

(57) ABSTRACT

A system and method of controlling a fuel injector is provided. A first injection signal is applied to a hydraulically actuated fuel injector to inject a quantity of fuel into a combustion chamber of an internal combustion engine. An amount of an operating fluid used by the fuel injector to inject the quantity of fuel into the combustion chamber is calculated. The amount of fuel injected into the combustion chamber is estimated based on the amount of operating fluid used by the fuel injector. A viscosity parameter is determined for the fuel injector based on the duration of the first injection signal and the estimated amount of fuel injected into the combustion chamber.

24 Claims, 6 Drawing Sheets

FUEL INJECTION CONTROL SYSTEM AND METHOD

TECHNICAL FIELD

The present invention is directed to a fuel injection control system and method. More particularly, the present invention is directed to a system and method for controlling a hydraulically-actuated fuel injector.

BACKGROUND

Environmental concerns have made the reduction of emission an important factor in the design and control of an internal combustion engine. One method of reducing the emissions generated by an internal combustion engine involves precisely controlling the timing and amount of fuel injected into the combustion chambers of the internal combustion engine.

An internal combustion engine may include a fuel injection system that injects fuel to the combustion chambers. The fuel injection system typically includes one fuel injector for each combustion chamber. The fuel injectors may be, for example, hydraulically-actuated electronically-controlled unit injectors. This type of fuel injector dispenses a quantity of fuel into the combustion chamber of the engine based on the controlled introduction of a pressurized fluid, which pressurizes the fuel to injection pressure.

The internal combustion engine may also include an electronic control module ("ECM") that controls each fuel injector to deliver a certain quantity of fuel to each combustion chamber at a certain time in the operating cycle. The ECM may generate and apply an injection signal to each fuel injector to deliver a quantity of fuel to each combustion chamber. In the case of a hydraulically-actuated electronically-controlled fuel injector, the injection signal may be a current applied to a solenoid in the fuel injector. The current energizes the solenoid to open a valve, which allows the pressurized fluid to flow through the fuel injector and pressurize and deliver fuel to the combustion chamber. The magnitude and duration of the current determines the amount of fuel delivery.

Because the pressurized fluid is integral to the operation of the fuel injector, the properties of the pressurized fluid may impact the amount of fuel delivered for a given injection signal. For example, if the pressurized fluid has a relatively high viscosity, the amount of fuel delivered for a given injection signal may be different than the amount of fuel delivered when the pressurized fluid has a relatively low viscosity. Accordingly, the ECM may use the properties of the pressurized fluid as an input in determining the magnitude and duration of the injection signal.

As described in U.S. Pat. No. 6,102,004, the ECM may use the pressure of the pressurized fluid and the temperature of the engine as inputs when generating the injection signal. Based on these parameters, the ECM accesses a series of "calibration maps" that store data for the fuel injector. These calibration maps provide information on the required duration of the injection signal to achieve the desired fuel delivery amount given the particular operating conditions. Thus, the ECM may generate an appropriate injection signal based on the pressure of the operating fluid and the temperature of the engine.

However, generating these calibration maps may be an expensive and time-consuming process. Each fuel injector must be calibrated with each different type of operating fluid that may be used to operate the fuel injection system. This entails testing the fuel injector under a variety of pressure and temperature conditions for each different type of operating fluid.

In addition, this type of fuel injection control system does not provide for any feedback on the fuel injection process. The ECM is not able to determine if there is a difference between the desired amount of fuel delivery and the actual amount of fuel delivery. If there is a significant difference, such as, for example, too much fuel is delivered to the combustion chamber, the engine may generate excessive emissions and/or experience "rough" running conditions. The current fuel injection control systems do not provide for the correction of future fuel injections based on fuel delivery discrepancies in past fuel injections.

The fuel injection control system of the present invention solves one or more of the problems set forth above.

SUMMARY OF THE INVENTION

One aspect of the present invention is directed to a method of controlling a fuel injector. A first injection signal is applied to a hydraulically actuated fuel injector to inject a quantity of fuel into a combustion chamber of an internal combustion engine. An amount of an operating fluid used by the fuel injector to inject the quantity of fuel into the combustion chamber is calculated. The amount of fuel injected into the combustion chamber is estimated based on the amount of operating fluid used by the fuel injector. A viscosity parameter is determined for the fuel injector based on the duration of the first injection signal and the estimated amount of fuel injected into the combustion chamber.

In another aspect, the present invention is directed to a fuel injection system. The fuel injection system includes a fluid supply rail configured to conduct a pressurized fluid. A fuel injector having a valve is configured to introduce an amount of pressurized fluid into the fuel injector from the fluid supply rail. The fuel injector is configured to release an amount of fuel in response to the introduction of the pressurized fluid. An electronic control module is configured to apply a first injection signal to the fuel injector to modulate the valve, to calculate the amount of pressurized fluid used by the fuel injector, to calculate an amount of fuel injected into the combustion chamber based on the calculated amount of pressurized fluid used by the fuel injector, and to determine a viscosity parameter indicating the sensitivity of the fuel injector to the properties of the pressurized fluid.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate exemplary embodiments of the invention and together with the description, serve to explain the principles of the invention. In the drawings.

DETAILED DESCRIPTION

Reference will now be made in detail to exemplary embodiments of the invention, which are illustrated in the accompanying drawings. Wherever possible, the same reference numbers will be used throughout the drawings to refer to the same or like parts.

Figure 1:
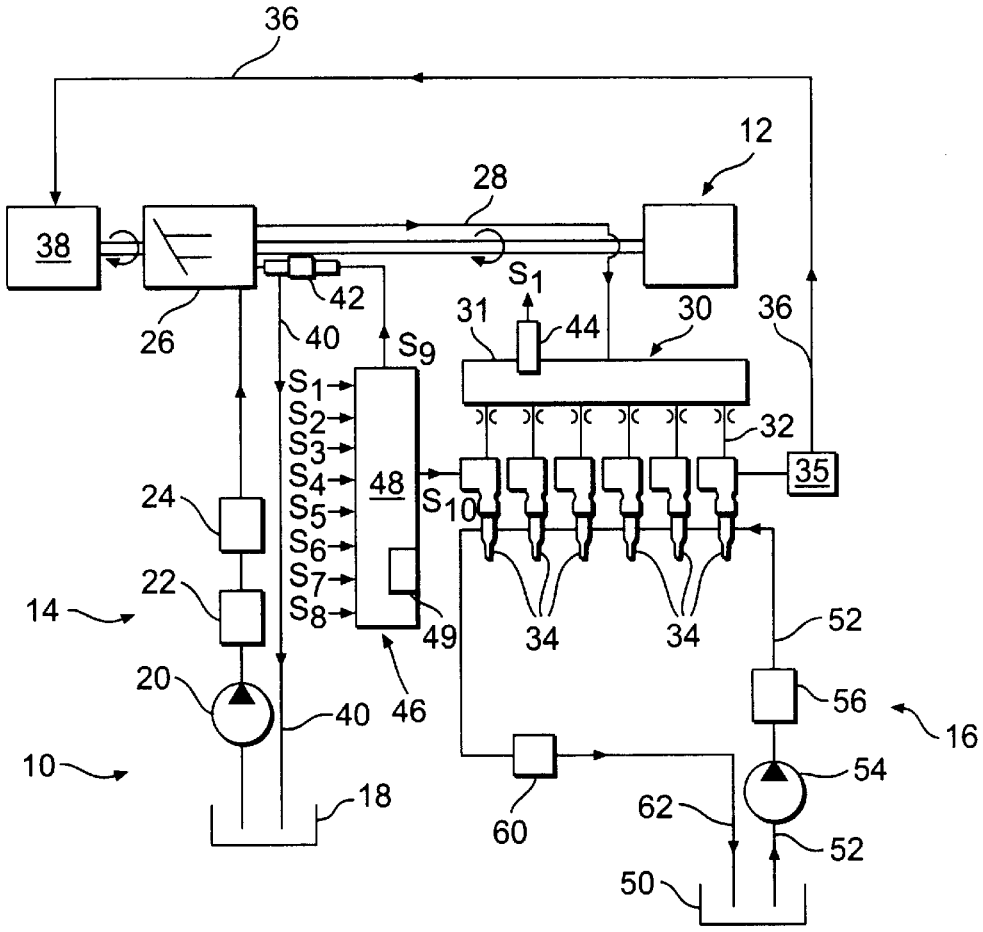
FIG. 1 is a schematic and diagrammatic illustration of a fuel injection control system in accordance with an exemplary embodiment of the present invention.

An exemplary embodiment of a fuel injection control system is illustrated in FIG. 1 and is designated generally by reference number 10. The illustrated fuel injection control system 10 is adapted for a direct-injection diesel cycle internal combustion engine 12. It should be understood, however, that fuel injection control system 10 may be used with other types of internal combustion engines, such as, for example, gasoline or natural gas engines.

Fuel injection control system 10 includes an operating fluid supply system 14. Operating fluid supply system 14 includes a tank 18 configured to hold a supply of operating fluid, which may be, for example, hydraulic oil or fuel. A first source of pressurized fluid 20, which may be, for example, a pump, draws operating fluid from tank 18 and increases the pressure of the operating fluid. First source of pressurized fluid 20 may direct the pressurized operating fluid through a fluid cooler 22 and one or more fluid filters 24.

As also shown in FIG. 1, operating fluid supply system 14 further includes a second source of pressurized fluid 26, which may be, for example, a pump. Second source of pressurized fluid 26 receives the filtered operating fluid and further increases the pressure of the operating fluid. Second source of pressurized fluid 26 directs the pressurized operating fluid into a fluid supply line 28.

As further shown in FIG. 1, fluid supply line 28 connects second source of pressurized fluid 26 with an operating fluid manifold 30. Operating fluid manifold 30 includes a fluid supply rail 31. A pressure sensor 44 may be disposed in fluid supply rail 31. Pressure sensor 44 senses the pressure of the operating fluid in fluid supply rail 31 and generates a signal $S_1$ indicative of the sensed pressure for a given time. Pressure sensor 44 may be any sensor readily apparent to one skilled in the art.

Fluid supply rail 31 provides pressurized operating fluid to a series of branch passageways 32. Each of the series of branch passageways 32 leads to a fuel injector 34. As described in greater detail below, the pressurized operating fluid is used by each fuel injector 34 to inject an amount of fuel into a combustion chamber of engine 12.

As shown in FIG. 1, a series of waste regulating valves 35 (one of which is illustrated in FIG. 1) are in fluid connection with each fuel injector 34.

Waste regulating valves 35 control the return of operating fluid from fuel injectors 34 to a fluid return line 36. Under certain circumstances, the fluid released from each fuel injector 34 may be pressurized.

As also illustrated in FIG. 1, return line 36 may be connected to a hydraulic motor 38. Hydraulic motor 38 may be connected to second source of pressurized fluid 26. Hydraulic motor 38 may use the pressure of the returned hydraulic fluid to generate work, which may be applied to second source of pressurized fluid 26 to assist in the pressurization of operating fluid for use in actuating fuel injectors 34.

As illustrated in FIG. 1, a release line 40 may connect second source of pressurized fluid 26 with tank 18. A valve 42 may be disposed in release line 40. Valve 42 regulates the flow of fluid from second source of pressurized fluid 26 to tank 18. Valve 42 may direct some operating fluid to tank 18 to control the pressure of the operating fluid flowing to fluid manifold 30.

As further shown in FIG. 1, a fuel supply system 16 provides fuel to fuel injectors 34. Fuel supply system 16 includes a fuel tank 50 and a fuel pump 54. Fuel pump 54 draws fuel from fuel tank 50 and passes the fuel through one or more fuel filters 56 and into fuel supply line 52. Fuel supply line 52 directs the fuel into fuel injectors 34.

A fuel return line 62 connects fuel injectors 34 with fuel tank 50. Return line 62 provides a passageway for fuel to return from fuel injectors 34 to fuel tank 50. A regulating valve 60 may be disposed in fuel return line 62 to control the flow of fuel from fuel injectors 34 to fuel tank 50.

Figure 2:
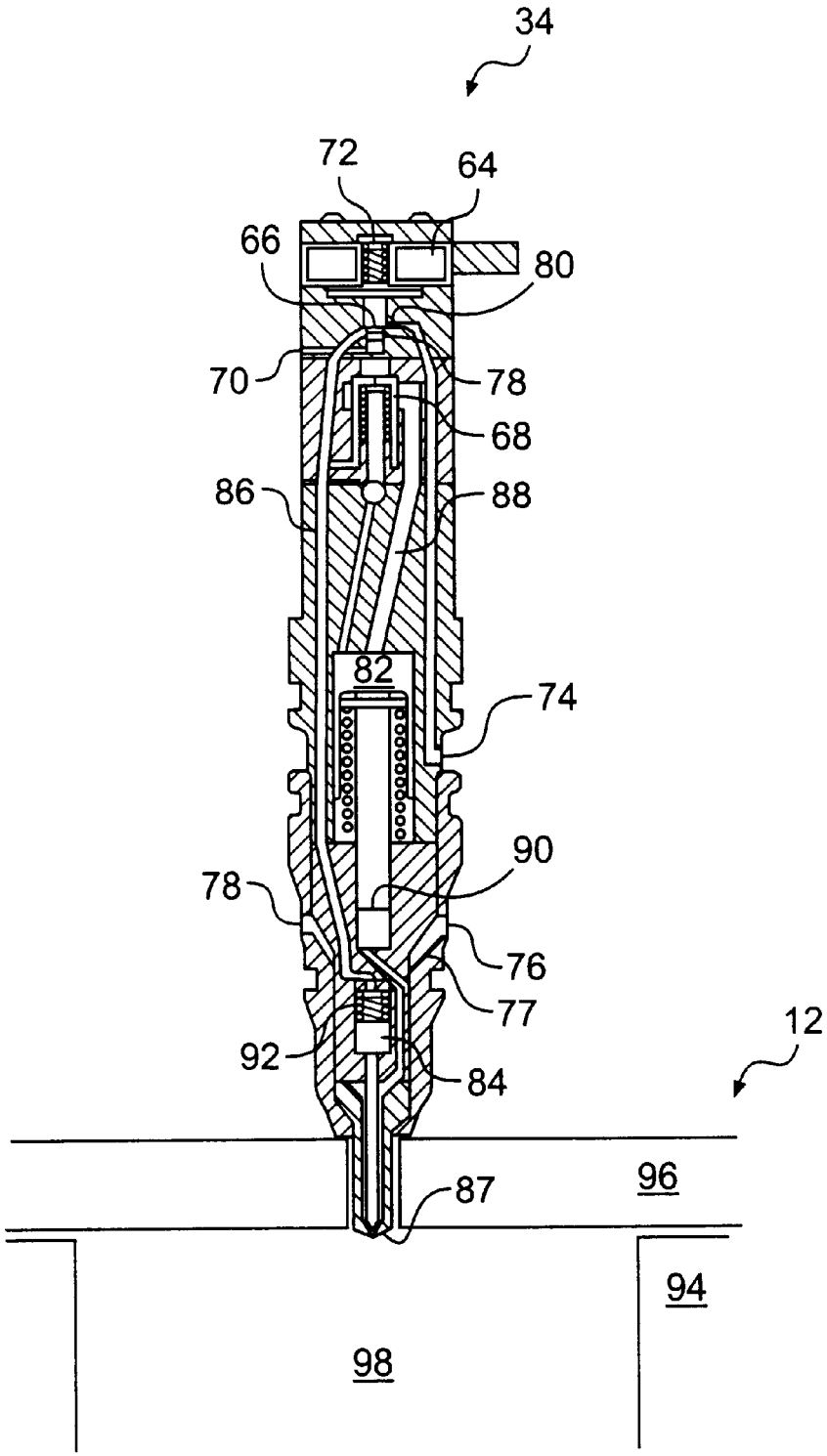
FIG. 2 is a diagrammatic illustration of a fuel injector in accordance with an exemplary embodiment of the present invention.

An exemplary embodiment of a fuel injector 34 is illustrated in FIG. 2. In the illustrated exemplary embodiment, fuel injector 34 is hydraulically-actuated and electronically-controlled. It should be understood that a variety of alternative embodiments of fuel injector 34 will be readily apparent to one skilled in the art.

As shown in FIG. 2, fuel injector 34 includes a fuel inlet 76 that is connected with fuel supply line 52 (referring to FIG. 1). Fuel injector 34 includes a fuel passageway 77 that conducts the fuel from fuel inlet 76 to a nozzle 87. Nozzle 86 may extend through a cylinder head 96 of engine 12. Nozzle 87 may be configured to inject fuel into a combustion chamber 98 defined by an engine block 94 of engine 12.

As further shown in FIG. 2, an check valve 84 is disposed in nozzle 87 of fuel injector 34. Check valve 84 may move between a closed position where check valve 84 blocks nozzle 87 and an open position where check valve allows fuel to flow through nozzle 87. A spring 92 may bias check valve 84 into the closed position.

Fuel injector 34 also includes an intensifier piston 82. Intensifier piston 82 is disposed adjacent a chamber 90 in fuel passageway 77. In response to a force exerted on the head of the piston, intensifier piston 82 exerts a corresponding force on fuel contained within chamber 90. This force acts to increase the pressure of the fuel between chamber 90 and nozzle 87. The pressure of the fuel exerts a force on check valve 84 that opposes the force of spring 92 acting on check valve 84. When the force exerted by the fuel on check valve 84 exceeds the spring force, check valve 84 will move to the open position and allow the pressurized fuel to flow through nozzle 87 and into combustion chamber 98.

Fuel injector 34 also includes fluid inlet 74 that is configured to receive pressurized operating fluid from branch passage 32 of fluid supply rail 31 (referring to FIG. 1). Fuel injector 34 uses the pressurized operating fluid to exert forces on each of the intensifier piston 82 and the check valve 84. Fuel injector 34 includes a first valve 66 and a second valve 68 that control the flow of the pressurized operating fluid through fuel injector 34.

As shown in FIG. 2, fuel injector 34 includes a first passageway 86 that directs the pressurized operating fluid from fluid inlet 74 to check valve 84. First passageway 86 includes a low pressure seat 78 and a high pressure seat 80. When first valve 66 is engaged with low pressure seat 78, first passageway 86 is connected with fluid inlet 74. When first valve 66 is engaged with high pressure seat 80, first passageway 86 is connected with a fluid drain 70.

First valve 66 may include a solenoid 64 that is configured to move first valve 66 between low pressure seat 78 and high pressure seat 80. A spring 72 may be engaged with first valve 66 to return first valve 66 to low pressure seat 78 when solenoid 64 is de-energized. Thus, energizing solenoid 64 will move first valve 66 to high pressure seat 80 to allow pressurized operating fluid to flow from fluid inlet 74 towards check valve 84. The pressurized operating will fluid will exert a closing force on check valve 84. De-energizing solenoid 64 moves first valve to the low pressure seat 78 and allows the pressurized operating fluid to escape from first passageway 86 through fluid drain 70. This will relieve the closing force exerted on check valve 84.

Fuel injector 34 also includes a second passageway 88 that conducts pressurized operating fluid from fluid inlet 74 to intensifier piston 82.

Second valve 68 is disposed in second passageway 88 and controls the flow of operating fluid through second passageway 88. Second valve 68 may be, for example, a shuttle valve that is spring biased into a closed position where flow between fluid inlet 74 and second passageway 88 is blocked. In addition, a branch passageway from first passageway 86 may direct pressurized operating fluid from first passageway 86 against second valve 68 to exert an additional closing force on second valve 68.

Second valve 68 may be opened when subject to a pressure differential. As shown in FIG. 2, pressurized fluid from fluid inlet 74 is directed against second valve 68 and exerts an opening force on second valve 68. When solenoid is energized to move first valve 66 to high pressure seat 80, the pressurized operating fluid in first passageway 86 will escape through drain 70, thereby relieving the closing force exerted by the pressurized operating fluid on second valve 68. The resulting opening force exerted on second valve 68 by the pressurized operating fluid from fluid inlet 74 will overcome the spring bias and open second valve 68. When second valve 68 is open, pressurized operating fluid may flow through second passageway 88 to intensifier piston 82. The pressurized operating fluid acts through intensifier piston 82 to increase the pressure of the fuel in chamber 90, which, in turn, exerts a force on check valve 84. When the force of the pressurized fluid acting on check valve 84 exceeds the force of spring 92, check valve 84 moves to an open position and allows fuel to flow through nozzle 87.

The flow of fuel through nozzle 87 may be stopped by de-energizing solenoid 64 and allowing spring 72 to move first valve 66 to low pressure seat 78. This allows pressurized operating fluid to flow through first passageway 86 to exert a closing force on check valve 84. The closing force of the pressurized operating fluid will overcome the opening force generated by the pressurized fuel and will move check valve 84 to the closed position.

The flow of fuel through nozzle 87 may be restarted by energizing solenoid 64 to move first valve 66 to high pressure seat 80. This allows the pressurized fluid in first passageway 86 to drain, thereby relieving the closing force on check valve 84. Thus, the force of the pressurized fuel will again move check valve 84 to the open position and fuel will flow through nozzle 87 into combustion chamber 98.

As illustrated in FIG. 1, fuel injection system 10 includes a computer 46 that generates an injection signal to control the release of fuel from fuel injector 34. Computer 46 may include an electronic control module 48 that has a microprocessor and memory 49. As is known to those skilled in the art, the memory is connected to the microprocessor and stores an instruction set and variables. Associated with the microprocessor and part of electronic control module 48 are various other known circuits such as, for example, power supply circuitry, signal conditioning circuitry, and solenoid driver circuitry, among others.

Electronic control module 48 may be programmed to control: 1) the fuel injection timing; 2) the total fuel injection quantity during an injection cycle; 3) the fuel injection pressure; 4) the number of separate injections or injection segments during each injection cycle; 5) the time intervals between the injection segments; 6) the fuel quantity of each injection segment during an injection cycle; 7) the operating fluid pressure; 8) the current level of the injection waveform; and/or 9) any combination of the above parameters. Computer 46 may receive a plurality of sensor input signals $S_1$–$S_8$, which correspond to known sensor inputs relating to engine operating conditions. For example, sensor inputs may include, fluid supply rail 31 pressure, engine temperature, engine load, etc. Electronic control module 48 may use these sensor inputs to determine the precise combination of injection parameters to execute a particular injection event.

Electronic control module 48 controls each fuel injection by generating and applying an injection signal, which may be, for example, a current, to solenoid 64 of fuel injector 34. As will be apparent from the previous discussion, however, the responsiveness of fuel injector 34 to the application of the injection signal will depend, at least in part, on the properties of the operating fluid. For example, a fuel injector using an operating fluid with a high viscosity will experience a different response to a given injection signal than a fuel injector using an operating fluid with a low viscosity.

Figure 3:
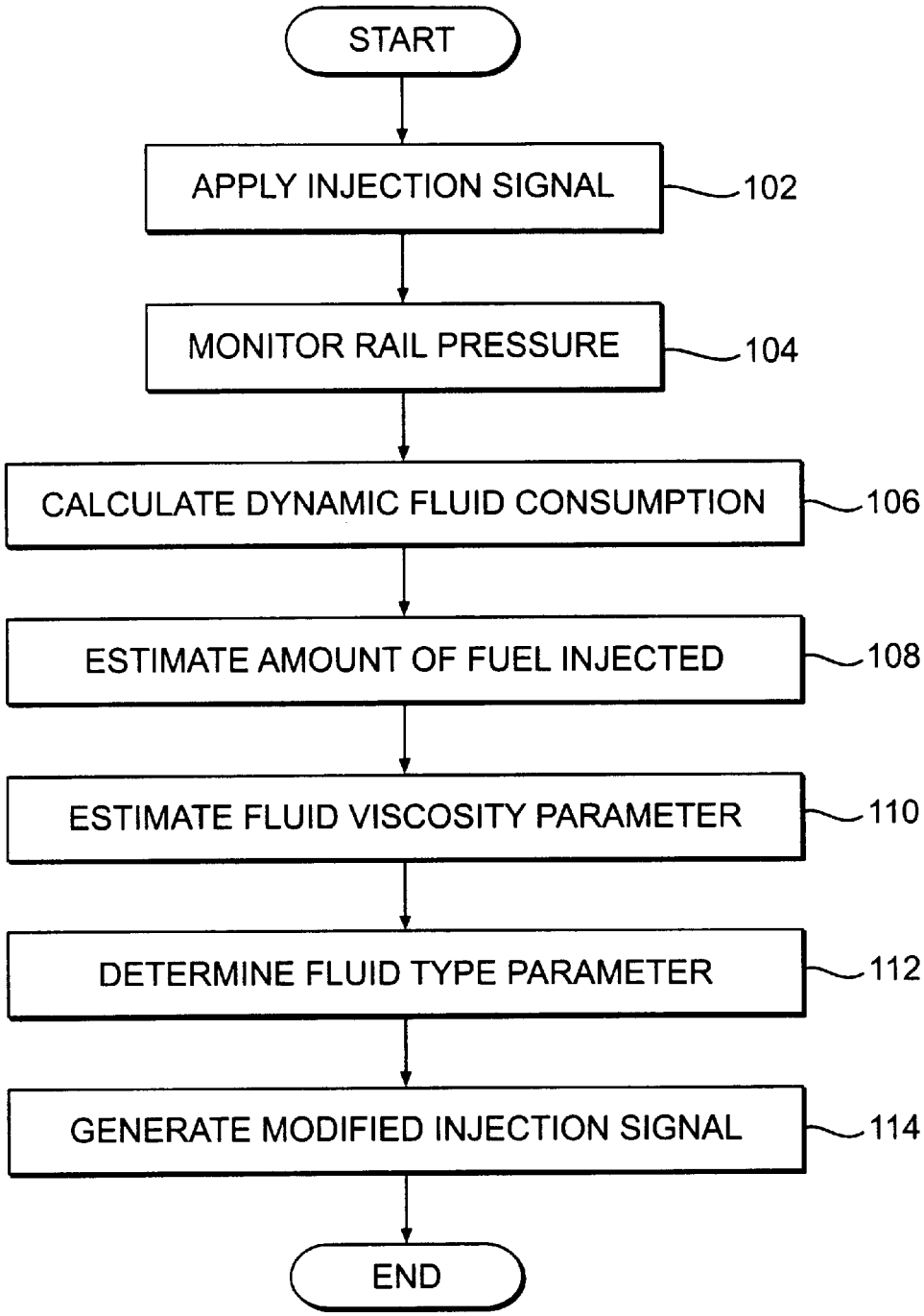
FIG. 3 is a flowchart illustrating a method of controlling a fuel injector in accordance with an exemplary embodiment of the present invention.

The flowchart of FIG. 3 illustrates an exemplary method of controlling a fuel injector 34 to account for the sensitivity of the fuel injector to the properties of the operating fluid. For the purposes of the present disclosure, the operation of a single fuel injector will be described. It should be understood, however, that multiple fuel injectors may be controlled in the same or a like manner.

Electronic control module 48 will generate an initial injection signal. (Step 102). The initial injection signal may be based on typical operating parameters and engine performance estimates, such as, for example, engine temperature, engine load, operating fluid pressure, etc. The initial injection signal may be further based on an initial estimate of the oil viscosity derived from engine temperature and operating fluid pressure measurements. The initial injection signal is then applied to fuel injector 34.

Figure 4:
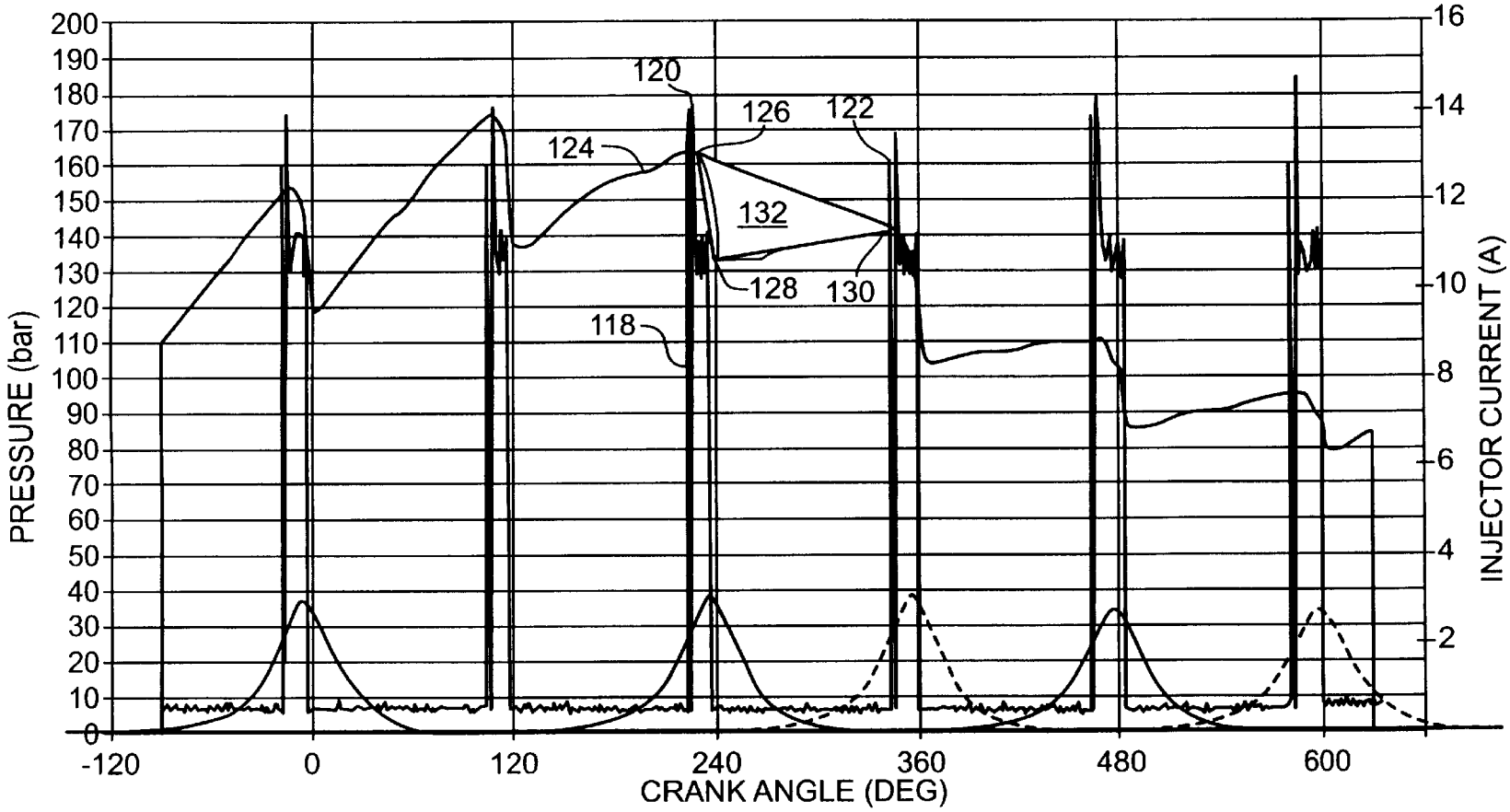
FIG. 4 is a graph illustrating an exemplary representation of the pressure of operating fluid in a fluid supply rail during a series of fuel injections.

The graph of FIG. 4 illustrates an exemplary current waveform 118 applied to a fuel injector 34 through several exemplary injection signals. A first injection signal is designated generally by reference number 120 and a second injection signal is designated generally by reference number 122. As noted previously, the current waveform of each injection signal is dependent upon the particular operating parameters of the engine.

The pressure of the operating fluid (curves 124) in fluid supply rail 31 is monitored as injection signals 120 and 122 are applied to fuel injector 34. (Step 104) FIG. 4 also illustrates the change in pressure of the operating fluid in fluid supply line 31 as fuel injector 34 executes injection signals 120 and 122. The pressure of the operating fluid in fluid supply rail 31 may be sampled periodically, such as, for example, every 6° of crankshaft rotation. Each sampled pressure value may be stored in memory 49.

Figure 5:
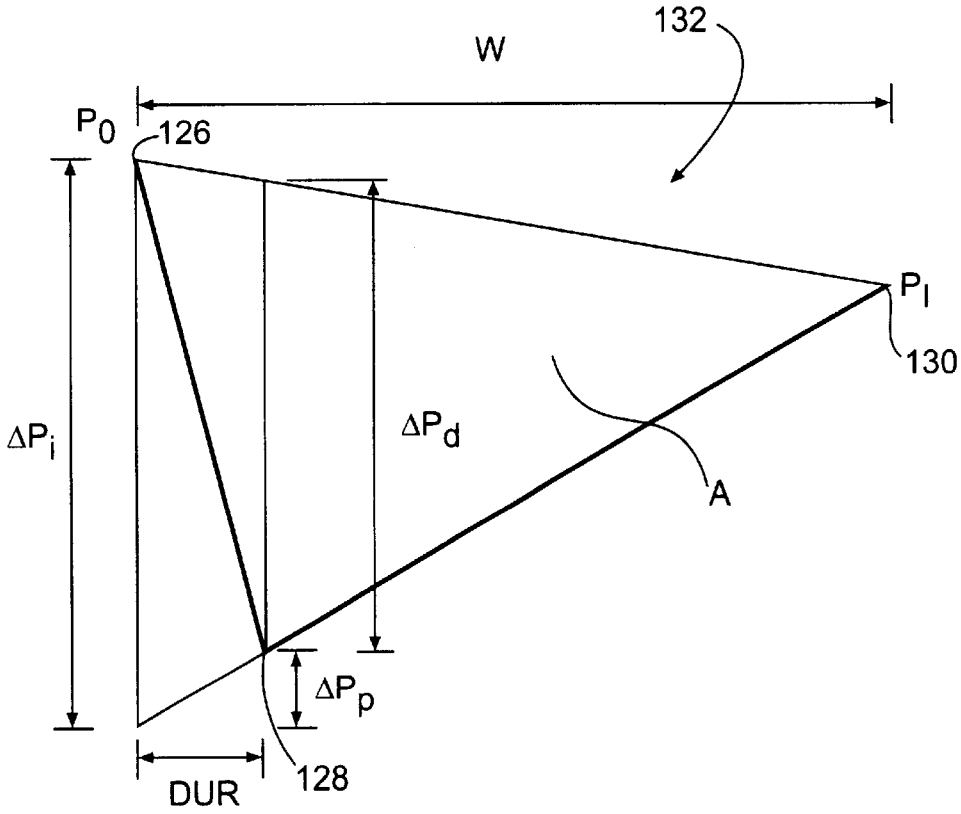
FIG. 5 is an enlarged view of an exemplary fluid supply rail pressure notch experienced during a fuel injection event.

As shown in FIGS. 4 and 5, a notch 132 may be formed in a plot of the pressure in fluid supply rail 31 as a function of crankshaft rotation. Notch 132 may be defined by a first relative maximum 126 that immediately follows the initiation of first activation signal 120, a relative minimum 128 following the execution of first activation signal 120, and a second relative maximum 130 prior to the initiation of second activation signal 122.

Based on the plot of the pressure in fluid supply rail 31, electronic control module 48 may calculate the dynamic fluid consumption of fuel injector 34 during execution of an injection signal. (Step 106). The dynamic fluid consumption is a measure of the amount of operating fluid used by fuel injector 34 to execute the injection signal. The dynamic fluid consumption, $\Delta V_i$, may be determined with the following formula:

$$\Delta V_i = \frac{2 \cdot A \cdot V}{\beta \cdot (W - DUR)}$$

where A is a "notch" area, V is the volume of the fluid supply rail, β is the bulk modulus of the operating fluid, W is the time between the first relative pressure maximum and the second relative pressure maximum, and DUR is the time between the first relative pressure maximum and the first relative pressure minimum.

FIG. 5 illustrates an exemplary notch 132. The area (A) of notch 132, may be determined from the following equation:

$$A = \frac{W}{2} \cdot (P_0 + P_1) - \int_{P_0}^{P_1} P(\theta) \cdot d\theta$$

where W is the time between the first relative pressure maximum and the second relative pressure maximum, $P_0$ is the first relative maximum pressure, $P_1$ is the second relative maximum pressure, and θ is the rotation angle of the crankshaft.

The foregoing equations provide one method of estimating the dynamic fluid consumption of the fuel injector. It should be noted that alternative methods of determining the dynamic oil consumption may be readily apparent to one skilled in the art.

Based on the dynamic oil consumption of the fuel injector 34, electronic control module 48 may estimate the amount of fuel injected into the combustion chamber. (Step 108). For a given pressure of fluid supply rail 31, there is a relationship between the dynamic oil consumption $\Delta V_i$ and the amount of fuel injected. This relationship may be determined by testing the fuel injector at a variety of operating fluid pressures and measuring the oil consumption and the fuel delivery amount. The collected data may be stored in a three-dimensional calibration map. Electronic control module 48 may access the calibration map with the fluid supply rail pressure and the dynamic oil consumption to obtain an estimate of the amount of fuel injected into the combustion chamber.

The estimated fuel delivery amount may be used to identify potential problems in the fuel injection system. For example, an estimated fuel delivery amount that is above a normal operating range or below a normal operating range may indicate that the fuel injector is not functioning properly. Accordingly, electronic control module 48 may provide an indication that maintenance on the fuel injection system is necessary.

The estimated fuel injection amount may also be used to estimate a viscosity parameter for the operating fluid. (Step 110). For the purposes of the present disclosure, the viscosity parameter is an indication of the sensitivity of the fuel injector to the properties of the operating fluid. The viscosity parameter is not an absolute measurement of the viscosity of the operating fluid and may take additional properties of the operating fluid into account. In addition, the viscosity parameter may be independent of the actual type of operating fluid used to actuate the fuel injector.

As will be recognized by one skilled in the art, a relationship exists between the duration of the injection signal, the amount of fuel delivered, the pressure of the operating fluid in the fluid supply rail, and the viscosity parameter of the operating fluid. This relationship may be defined by obtaining calibration data for the fuel injector under a series of different operating conditions, such as, for example, different injection signal durations, fluid supply rail pressures, and engine temperatures. The calibration data may be stored in memory as one or more calibration maps.

Given the known fuel injection signal duration, the estimated fuel delivery amount, and fluid supply rail pressure, electronic control module 48 may access these calibration maps to obtain an estimate of the viscosity parameter. The viscosity parameter provides an indication as to the responsiveness of the fuel injector in the particular operating conditions of the engine. The viscosity parameter may be determined on an injector-by-injector basis. The viscosity parameter may then be used as an input, along with other pertinent engine operating conditions, to generate a future injection signal for the fuel injector.

The viscosity parameter may be also be used to determine a fluid type parameter. (Step 112). The fluid type parameter provides an indication of the type of fluid used as the operating fluid and is based on a relationship between the viscosity parameter and the engine temperature. The fluid type parameter may be used to predict changes in the viscosity parameter based on predicted changes in the engine temperature.

Figure 6:
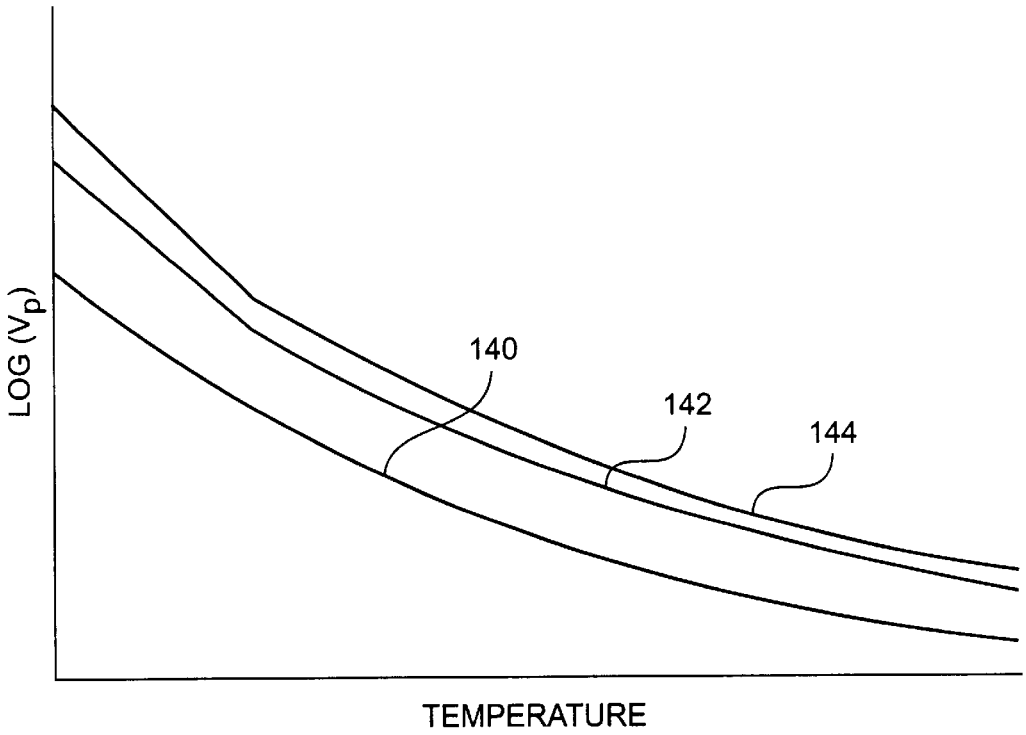
FIG. 6 is a graph illustrating a relationship between temperature and a viscosity parameter for a series of exemplary fluid types.

FIG. 6 illustrates. a series of exemplary fluid type parameters 140, 142, and 144. The fluid type parameters indicate the impact of different types of operating fluid on the viscosity parameter. For example, fluid type parameter 140 may be representative of the relationship of temperature and the viscosity parameter for 10W20 oil, whereas fluid type parameter 142 may be representative of the relationship of temperature and the viscosity parameter for 10W30 oil. Similar relationships may also be defined for other types of operating fluid.

The relationship of the fluid type parameter to the viscosity parameter may be stored in memory 49 of electronic control module 48. Given the estimate of the viscosity parameter and the engine temperature, electronic control module may estimate the fluid type parameter for the particular operating fluid. In other words, electronic control module 48 is able to estimate the type of operating fluid used to actuate the fuel injector without an external input.

Electronic control module 48 may use the fluid type parameter to predict a future viscosity parameter of the operating fluid and modify an injection signal accordingly. (Step 114). As illustrated in FIG. 6, the viscosity parameter for a given fluid type has an established relationship to the engine temperature. Thus, electronic control module 48 may predict the viscosity parameter of the operating fluid based on the expected engine temperature. For example, when the engine is first starting, the engine temperature will be relatively low. As the engine runs, the engine temperature will gradually increase. Given the operating conditions of the engine, electronic control module 48 may predict the temperature of the engine and, thus, the expected viscosity parameter.

Industrial Applicability

As will be apparent from the foregoing description, the present invention provides a system and method that allows for improved control over a hydraulically-actuated fuel injector. The present invention provides for the monitoring of engine operating conditions and the monitoring of the actual performance of a fuel injector 34 under the current engine operating conditions. This monitoring allows electronic control module 48 to determine an expected viscosity parameter of the operating fluid. The expected viscosity parameter may allow electronic control module 48 to predict the responsiveness of fuel injector 34 to the characteristics of the operating fluid. Thus, the expected viscosity parameter may be used as an input, along with other pertinent engine operating conditions, when determining the next injection signal. This allows electronic control module 48 to use information gathered during previous fuel injections as feedback in future fuel injections. The present invention, therefore, allows electronic control module 48 to generate injection signals that are tailored to the particular engine operating conditions, which may result in more precision in the control of a fuel injector.

An electronic control module monitors the response of a fuel injector to an injection signal by monitoring the pressure of the operating fluid in an operating fluid supply rail. By calculating the amount of operating fluid used by the fuel injector in executing the particular injection signal, the electronic control module may estimate the actual amount of fuel delivered to a combustion chamber. Once an estimate of fuel delivery is obtained, the electronic control module may determine a viscosity parameter based on the pressure in the fluid supply rail, the duration of the injection signal, and the estimated fuel delivery. The viscosity parameter provides an indication of the sensitivity of the fuel injector to the properties of the operating fluid.

The current viscosity parameter may be used as an input in generating a future injection signal. However, a change in the temperature of the engine between the determination of the viscosity parameter and the generation of the future injection signal may cause a change in the properties of the operating fluid. Accordingly, the current viscosity parameter may not be a precise indication of the future sensitivity of the fuel injector to the properties of the operating fluid.

The electronic control module may, however, estimate a fluid type parameter that defines a relationship between the viscosity parameter and the engine temperature. By identifying the fluid type parameter for the particular operating fluid, the electronic control module may predict the future viscosity parameter based on the expected engine temperature. Thus, the electronic control module may predict the viscosity parameter, or the sensitivity of the fuel injector, with a greater amount of precision.

The electronic control module accurately predicts the viscosity parameter for an upcoming fuel injection and the electronic control module alters the shape and/or form of the injection signal to account for the expected viscosity parameter. In addition, the electronic control module may use the expected viscosity parameter in controlling other engine functions, such as, for example, control over the pressure of the fluid in the fluid supply rail, control of the operating fluid pump and high pressure pump, and torque corrections.

Thus, the present invention allows for improved control over the fuel injection process. This increased control may allow for a reduction in the generation of emissions. The reduction in emissions may be particularly apparent in cold starts situations where the fuel injectors are particularly sensitive to the properties of the operating fluid. In addition, the increased precision may lead to improved engine performance, elimination of "rough running" symptoms, reduced cold start times, and improved load acceptance.

It will be apparent to those skilled in the art that various modifications and variations can be made in the fuel injection control system of the present invention without departing from the scope or spirit of the invention. Other embodiments of the invention will be apparent to those skilled in the art from consideration of the specification and practice of the invention disclosed herein. It is intended that the specification and examples be considered as exemplary only, with a true scope and spirit of the invention being indicated by the following claims and their equivalents.

What is claimed is:

1. A method of controlling a fuel injector, comprising:

applying a first injection signal to a hydraulically actuated fuel injector to inject a quantity of fuel into a combustion chamber of an internal combustion engine;

calculating an amount of an operating fluid used by the fuel injector to inject the quantity of fuel into the combustion chamber;

estimating the amount of fuel injected into the combustion chamber based on the amount of operating fluid used by the fuel injector; and determining a viscosity parameter for the fuel injector based on the duration of the first injection signal and the estimated amount of fuel injected into the combustion chamber.

2. The method of claim 1, further including monitoring the pressure of a fluid supply rail configured to supply the operating fluid to the fuel injector as the fuel injector injects the quantity of fuel into the combustion chamber and wherein the calculation of the amount of operating fluid used by the fuel injector is based on the monitored pressure in the fluid supply rail.

3. The method of claim 2, further including identifying a notch area in a plot of the pressure of the pressurized fluid in the fluid supply rail as a function of time.

4. The method of claim 2, wherein the amount of operating fluid used by the fuel injector is calculated based on a drop in the pressure in the fluid supply rail as the fuel injector executes the injection signal.

5. The method of claim 2, wherein the determination of the viscosity parameter is based on the monitored pressure in the fluid supply rail.

6. The method of claim 1, further including sensing an engine temperature and estimating a fluid type parameter based on the engine temperature and the viscosity parameter.

7. The method of claim 6, further including modifying a second injection signal to be applied to the fuel injector based on the fluid type parameter.

8. The method of claim 1, further including modifying a second injection signal to be applied to the fuel injector based on the viscosity parameter.

9. The method of claim 1, further including accessing a fuel injection calibration map to estimate the amount of fuel injected into the combustion chamber based on the amount of operating fluid used by the fuel injector.

10. The method of claim 1, further including accessing a viscosity calibration map to determine the viscosity parameter.

11. The method of claim 1, further including providing an indication when the estimated amount of fuel injected into the combustion chamber is less than a predetermined threshold.

12. The method of claim 1, further including providing an indication when the estimated amount of fuel injected into the combustion chamber is greater than a predetermined threshold.

13. A fuel injection system, comprising:

a fluid supply rail configured to conduct a pressurized fluid;

a fuel injector having a valve configured to introduce an amount of pressurized fluid into the fuel injector from the fluid supply rail, the fuel injector configured to release an amount of fuel in response to the introduction of the pressurized fluid; and an electronic control module configured to apply a first injection signal to the fuel injector to modulate the valve, to calculate the amount of pressurized fluid used by the fuel injector, to calculate an amount of fuel injected into the combustion chamber based on the calculated amount of pressurized fluid used by the fuel injector, and to determine a viscosity parameter indicating the sensitivity of the fuel injector to the properties of the pressurized fluid.

14. The fuel injection system of claim 13, further including a pressure sensor operable to sense the pressure of the pressurized fluid in the fluid supply rail.

15. The fuel injection system of claim 13, wherein the fuel injector includes a solenoid configured to modulate the valve.

16. The fuel injection system of claim 15, wherein the first injection signal is a current having a predetermined magnitude and duration and the first injection signal is applied to the solenoid to open the valve.

17. The fuel injection system of claim 13, further including a plurality of fuel injectors.

18. The fuel injection system of claim 13, wherein the electronic control module includes a memory configured to store data indicative of a relationship between the duration of the injection signal, pressure of the fluid supply rail, the amount of fuel delivered to the combustion chamber, and the viscosity parameter.

19. The fuel injection system of claim 18, wherein the memory of the electronic control module is further configured to store data indicative of a relationship between the viscosity parameter, an engine temperature, and a fluid type parameter.

20. The fuel injection system of claim 13, further including a temperature sensor configured to sense a temperature representative of the temperature of the engine.

21. An engine, comprising:

a fluid supply rail configured to conduct a pressurized fluid;

a pressure sensor operable to sense the pressure of the pressurized fluid in the fluid supply rail;

an engine block defining a plurality of combustion chambers;

a plurality of fuel injectors, each fuel injector having a valve configured to introduce an amount of pressurized fluid into the fuel injector from the fluid supply rail, the fuel injector configured to inject an amount of fuel into one of the plurality of combustion chambers in response to the introduction of the pressurized fluid; and an electronic control module configured to apply a first injection signal to the fuel injector to modulate the valve, to calculate the amount of pressurized fluid used by the fuel injector, to calculate an amount of fuel injected into the combustion chamber based on the calculated amount of pressurized fluid used by the fuel injector, to determine a viscosity parameter indicating the sensitivity of the fuel injector to the properties of the pressurized fluid, and to estimate a fluid type parameter for the pressurized fluid.

22. The engine of claim 21, wherein the electronic control module includes a memory configured to store a first set of data indicative of a relationship between the duration of the injection signal, the pressure of the fluid supply rail, the amount of fuel delivered to the combustion chamber, and the viscosity parameter and a second set of data indicative of a relationship between the viscosity parameter, an engine temperature, and the fluid type parameter.

23. The engine of claim 21, wherein the electronic control module modifies a second injection signal based on the determined viscosity parameter.

24. The engine of claim 21, wherein the electronic control module modifies a second injection signal based on the estimated fluid type parameter.

* * * * *